US010605452B2

(12) United States Patent
Tsai

(10) Patent No.: US 10,605,452 B2
(45) Date of Patent: Mar. 31, 2020

(54) GAS COMBUSTOR AND SAFETY SWITCH THEREOF

(71) Applicant: Wei-Ming Tsai, New Taipei (TW)

(72) Inventor: Wei-Ming Tsai, New Taipei (TW)

( * ) Notice: Subject to any disclaimer, the term of this patent is extended or adjusted under 35 U.S.C. 154(b) by 638 days.

(21) Appl. No.: 15/356,568

(22) Filed: Nov. 19, 2016

(65) Prior Publication Data

US 2018/0066842 A1 Mar. 8, 2018

(30) Foreign Application Priority Data

Sep. 2, 2016 (TW) ..... 105128535 A

(51) Int. Cl.
*F23D 14/28* (2006.01)
*F23D 14/00* (2006.01)
*F23D 14/38* (2006.01)

(52) U.S. Cl.
CPC ..... *F23D 14/28* (2013.01); *F23D 14/00* (2013.01); *F23D 14/38* (2013.01); *F23D 2203/00* (2013.01); *F23D 2209/00* (2013.01)

(58) Field of Classification Search
USPC ..... 431/344, 254
See application file for complete search history.

(56) References Cited

U.S. PATENT DOCUMENTS 6,166,339 A * 12/2000 Bechis ..... H01H 35/143 200/61.45 R
6,293,782 B1 9/2001 Tsai
7,708,554 B2 * 5/2010 Tsai ..... F23Q 2/164 431/153
7,850,446 B2 12/2010 Tsai
9,435,486 B2 9/2016 Tsai
9,464,760 B2 10/2016 Tsai
9,784,446 B2 * 10/2017 Tsai ..... F23D 14/28
2003/0124476 A1 * 7/2003 Chung Yang ..... F23Q 2/164 431/153
2011/0053103 A1 * 3/2011 Burdsall ..... F23D 14/465 431/254
2016/0097530 A1 4/2016 Tsai

* cited by examiner

*Primary Examiner* — Steven B McAllister
*Assistant Examiner* — John E Bargero
(74) *Attorney, Agent, or Firm* — Guice Patents PLLC

(57) ABSTRACT

A gas combustor comprises a gas container, a fuel gas controlling device, a housing, a piezoelectric device and a combustion device. The safety switch is slidably disposed in an opening of the housing and includes a slide member, a fasten member and a passive member, adjacent surfaces of the slide member and the fasten member are disposed with a connecting mechanism and a radial sliding mechanism, thereby enabling the slide member to perform a radial sliding motion towards the left or the right at the front end of the fasten member; a rear surface of the passive member is formed with a lock tenon abutted against a block tenon of the fuel gas controlling device, thereby forming a lucked status; when the slide member is pulled towards the left or the right, the lock tenon is released from the block tenon, thereby forming an unlocked status.

23 Claims, 12 Drawing Sheets

GAS COMBUSTOR AND SAFETY SWITCH THEREOF

BACKGROUND OF THE INVENTION

1. Field of the Invention

The present invention relates to a gas combustor, especially to a modularized gas combustor having a rapid assembly function. Furthermore, the present invention provides a safety switch for use in gas combustor.

2. Description of Related Art

Fire is a must have element in our lives, with fire, we can cook food, can be provided with lighting, and the fire can also be used for combustion operations such as forging, soldering and welding. Take a gas combustor, e.g. a refillable lighter or a portable stove, as an example, liquid gas is adopted for lighting objects or cooking food. As such, the gas combustor still plays an important role in our lives which cannot be easily replaced.

Take the hand-held gas combustion apparatus disclosed in Taiwan Patent No.M338954 (corresponding to U.S. Pat. No. 7,850,446) as an example, the hand-held gas combustion apparatus comprises a gas storing tank, a gas discharging device, a housing, an ignition device, a safety switch and a flame device. The housing is disposed above the gas storing tank, and the interior of the housing is preformed with a positioning member such as a plurality of accommodation slots allowing a piezoelectric device and a recovery member, e.g. a spring, of the ignition device to be received. When being operated, firstly a user has to release the safety switch which is located below a button and in a locked status, so that the button is enabled to be pressed. During the process of pressing the button, the piezoelectric device and the recovery device are respectively squeezed and pressed, so that static sparks are generated near a flame nozzle of the flame device for igniting a mixed fuel gas ejected from the flame nozzle; on the other hand, a push rod preformed on the button is served to push a gas discharging plate, so a gas discharging nozzle of the gas storing tank is pulled for forming a gas supplying status, and the fuel gas is able to be conveyed to the flame device via a gas conveying pipe for being mixed with air in a mixing pipe and lastly ejected from the flame nozzle.

Moreover, take the conventional safety switch of gas combustor disclosed in Taiwan Patent No.446104 (corresponding to U.S. Pat. No. 6,293,782) as an example, the safety switch of gas combustor includes a fasten member, a press member and a slide member; the press member is moveably and longitudinally disposed at one end of the fasten member, and the slide member is moveably and longitudinally disposed at another end of the fasten member, and an interfere status is formed at adjacent portions of the press member and the slide member. For preventing the slide member from being longitudinally released from the fasten member, the slide member is formed with an elongated sleeve slot sleeved in a positioning pin preformed on the fasten member, then a screw is utilized for locking the positioning pin, so that the slide member can be prevented from being released from the fasten member.

However, the above-mentioned safety switch is formed as an individual unit and arranged below the button for longitudinally locking or unlocking the button. In fact, if the safety switch can be directly installed on the button and synchronously moved with the button, more operation conveniences can be provided, Furthermore, in actual practice, users have different habits for operating a button or switch, for example using his/her right or left hand, this brings more difficulties in the design of unlocking operation, and the button and the safety switch cannot be integrated. Accordingly, the above-mentioned disadvantages shall be improved.

SUMMARY OF THE INVENTION

One primary objective of the present invention is to provide a gas combustor, which includes a safety switch cable of being bidirectionally unlocked and pressed for operation, and the safety switch is suitable to be operated by both of a right-hand user and a left-hand user, thereby increasing the operation convenience of the gas combustor.

For achieving said objective, one technical solution provided by the present invention is to provide a gas combustor, which comprises: a gas container with the top end thereof formed with a connection part having a discharging nozzle; a fuel gas controlling device, including a base connected to the connection part, wherein the exterior of the base is formed with a block tenon, and the interior thereof is formed with a fuel gas passageway for receiving fuel gas supplied from the discharging nozzle, an upstream end of the fuel gas passageway is disposed with an air inlet control valve, the air inlet control valve is closed in the normal status, and the front end of the air inlet control valve is axially disposed with an air inlet control rod capable of allowing an opened loop to be formed, so that the fuel gas is able to be discharged from a gas ejecting nozzle disposed at a downstream end of the fuel gas passageway, the gas ejecting nozzle is received in an insertion slot allowing a combustion device to be inserted and positioned; a housing, used for enclosing and fastening the gas container and the fuel gas controlling device, and including a front opening and a top opening allowing the combustion device to be disposed, wherein the interior of the front opening is formed with a fasten slot allowing a piezoelectric device to be disposed therein, and the piezoelectric device includes an electric wire capable of penetrating into the combustion device; and a safety switch, slidably disposed in the front opening and including a slide member, a fasten member and a passive member; adjacent surfaces of the slide member and the fasten member are disposed with a connecting mechanism and a radial sliding mechanism, wherein a rear surface of the slide member is staggeringly arranged with a left support arm and a right support arm, the fasten member is formed with a left wall and a right wall respectively corresponding to the left support arm and the right support arm, a left spring is disposed between the left support arm and the left wall, and a right spring is disposed between the right support arm and the right wall, thereby enabling the slide member to perform a radial sliding motion towards the left or the right at the front end of the fasten member and preventing the slide member from being axially released; the passive member is arranged at the rear end of the fasten member and connected to the slide member via a fastening structure, and a rear surface of the passive member is formed with a lock tenon capable of being abutted against the block tenon, thereby forming a lucked status; when the slide member is pulled towards the left or the right, the passive member is synchronously moved with the slide member, and the lock tenon is released from the block tenon, thereby forming an unlocked status, so that the safety switch is able to be pressed in the front opening, and the piezoelectric device and the air inlet control rod are respectively squeezed and pushed at the same time.

Another objective of the present invention is to provide a safety switch for use in gas combustor, which has a function of being bidirectionally unlocked and pressed for operation, and the safety switch is suitable to be operated by both of a right-hand user and a left-hand user, thereby increasing the operation convenience of the gas combustor.

For achieving said objective, one technical solution provided by the present invention is to provide a safety switch for use in gas combustor, slidably disposed in an opening of a gas combustor and comprising a slide member, a fasten member and a passive member, wherein adjacent surfaces of the slide member and the fasten member are disposed with a connecting mechanism and a radial sliding mechanism, a rear surface of the slide member is staggeringly arranged with a left support arm and a right support arm, the fasten member is formed with a left wall and a right wall respectively corresponding to the left support arm and the right support arm, a left spring is disposed between the left support arm and the left wall, and a right spring is disposed between the right support arm and the right wall, thereby enabling the slide member to perform an elastic radial sliding motion towards the left or the right at the front end of the fasten member and preventing the slide member from being axially released; the passive member is arranged at the rear end of the fasten member and connected to the slide member via a fastening structure, and a rear surface of the passive member is formed with a lock tenon capable of being abutted against a block tenon preformed in the gas combustor, thereby forming a lucked status; when the slide member is pulled towards the left or the right, the passive member is synchronously moved with the slide member, and the lock tenon is released from the block tenon, thereby forming an unlocked status, so that the safety switch is able to be pressed in the opening.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
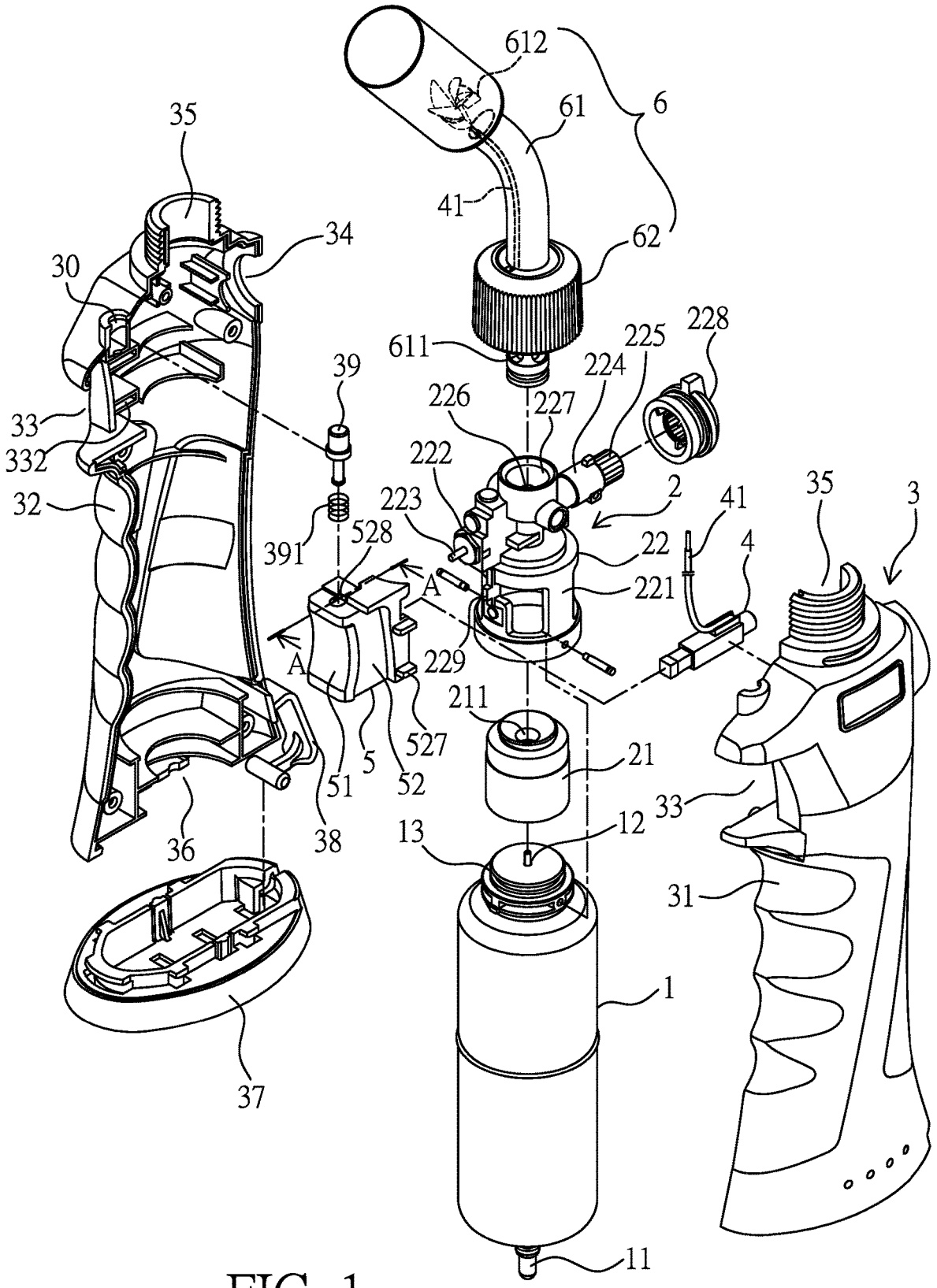
FIG. 1 is a perspective exploded view illustrating the gas combustor according to the present invention.
Figure 2:
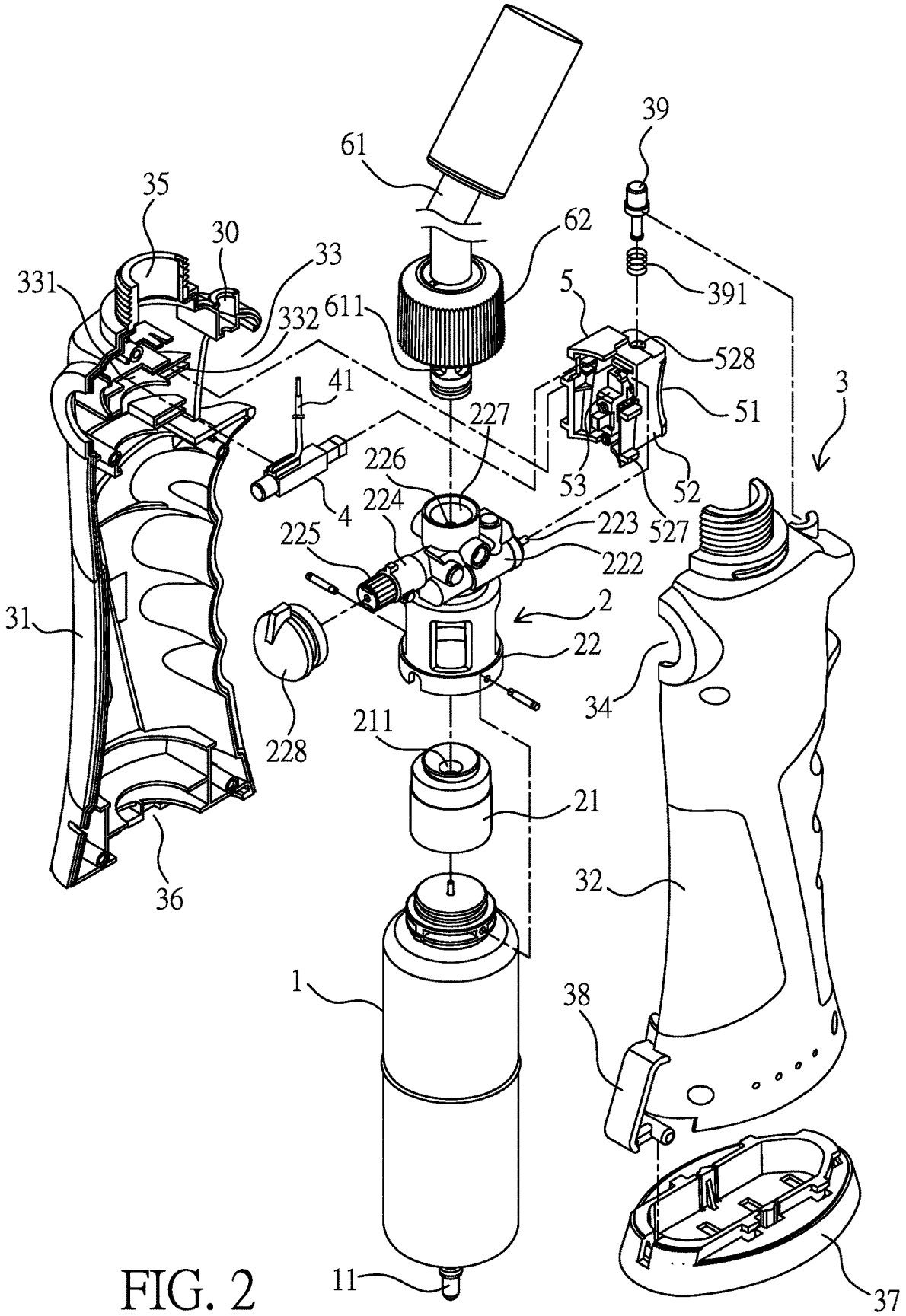
FIG. 2 is another perspective exploded view illustrating the gas combustor according to the present invention.
Figure 3:
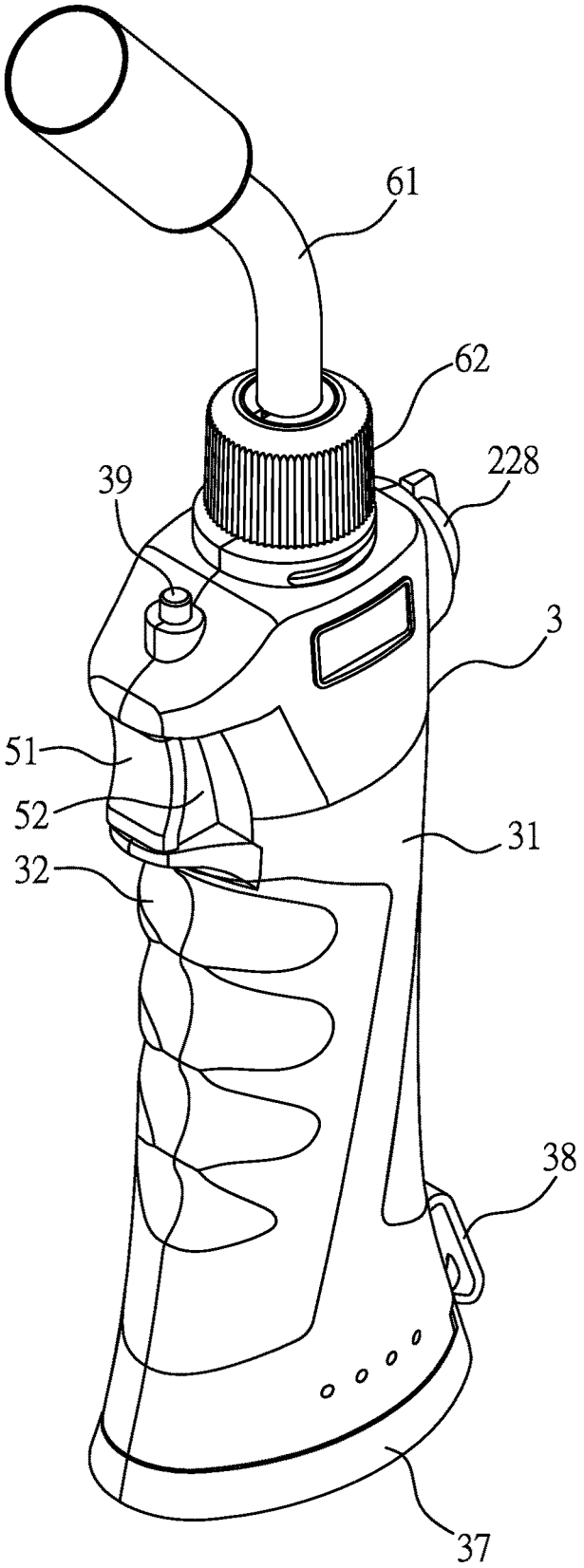
FIG. 3 is a perspective view illustrating the assembly of the gas combustor according to the present invention.

Referring from FIG. 1 to FIG. 3, the present invention provides a gas combustor, which mainly comprises a gas container 1, a fuel gas controlling device 2, a housing 3, a piezoelectric device 4, a safety switch 5 and a combustion device 6.

The gas container 1 is provided with a function of being repeatedly filled and stored with liquid gas, for example the disclosure which has been disclosed in Taiwan Patent Application No.103108440 (corresponding to U.S. Pat. No. 9,435,486B2). As such, the bottom end and the top end of the gas container 1 formed as a metal cylinder are respectively provided with a filling nozzle 11 and a discharging nozzle 12. The filling nozzle 11 has been disclosed in Taiwan Patent Application No.103113014 (corresponding to U.S. patent application Ser. No. 14/317,191 which has been granted to the applicant), therefore no further illustration is provided. The filling nozzle 11 is connected to a discharging valve of a canned gas (not shown in figures), then high-pressure liquid gas is able to be filled and stored in the gas container 1. The top end of the gas container 1 is formed with a connection part 13 allowing the discharging nozzle 12 to be connected, wherein in actual practice, the connection part 13 can be formed as a thread segment.

The fuel gas controlling device 2 includes a base 22 connected to the connection part 13, the interior of the base 22 is formed with a fuel gas passageway (not shown in figures due to projection angle) for receiving fuel gas supplied from the discharging nozzle 12. Wherein, the base 22 further includes a fuel gas vaporizing device 21, the fuel gas vaporizing device 21 is connected to the discharging nozzle 12, so that the discharging nozzle 12 is able to be in an intermittent fuel gas supplying status for allowing the fuel gas to be stably vaporized in the fuel gas vaporizing device 21, the fully-vaporized fuel gas is discharged from a gas discharging hole 211 formed at the top end of the fuel gas vaporizing device 21 so as to enter the base 22. Wherein, the fuel gas vaporizing device 21 has been disclosed in Taiwan Patent No.M505591 (corresponding to U.S. Patent Application Publication No.2016/0097530A1), therefore no further illustration is provided.

The base 22 is an integrally-formed seat member, the bottom end thereof is disposed with a hollow supporter 221 connected to the connection part 13, thereby allowing the fuel gas vaporizing device 21 to be disposed in the supporter 221, the interior of the fuel gas passageway of the base 22 is disposed with an air inlet control valve 222, the air inlet control valve 222 is closed in the normal status, and the front end thereof is axially disposed with an air inlet control rod 223, the air inlet control rod 223 is able to be pressed for forming an opened loop for allowing the fuel gas to continuously pass the fuel gas passageway so as enter a discharging adjustment valve 224 disposed in the fuel gas passageway and having a function of adjusting the fuel gas discharging amount, a discharging adjustment rod 225 is provided and rotated in the discharging adjustment valve 224 for adjusting the discharging amount, so that the diameter of the fuel gas passageway can be adjusted with a shielding means. The fuel gas which has been adjusted by the discharging adjustment valve 224 is ejected from a gas ejecting nozzle 226 disposed at a downstream end of the fuel gas passageway. The gas ejecting nozzle 226 is received in an insertion slot 227, and the insertion slot 227 is served to allow the combustion device 6 to be inserted and positioned.

The housing 3 is composed of a left shell 31 and a right shell 32 being engaged with each other and used for enclosing and positioning the gas container 1 and the fuel gas controlling device 2 which have already been combined as one piece. The assembly of the gas combustor is shown in FIG. 3, a front opening 33 of the housing 3 is served to allow the safety switch 5 to be disposed; a rear opening 34 thereof is sleeved with a rotary button 228, and the rotary button 228 is sleeved with the discharging adjustment rod 225 so as to be synchronously rotated. A top opening 35 of the housing 3 is disposed with the combustion device 6, and a bottom opening 36 thereof is disposed with a bottom cover 37 for opening or closing the bottom opening 36.

A connection strip 38 made of an elastic polymer material is connected between the bottom cover 37 and the housing 3, thereby preventing the bottom cover 37 from being released from the housing 3. The bottom cover 37 is connected at one side of the bottom opening 36 via the connection strip 38, thereby avoiding being fallen off or lost. As such, a user can separate the bottom cover 37 from the housing 3 with a sliding means, so that the bottom opening 36 can be exposed and the gas container 1 can be processed with a gas filling operation through the filling nozzle 11.

The front opening 33 of the housing 3 is formed with a fasten slot 332 (as shown in FIG. 2) allowing the piezoelectric device 4 to be disposed, so that the front end of the piezoelectric device 4 can be arranged to be adjacent to the safety switch 5 disposed in the front opening 33. Wherein, the piezoelectric device 4 includes an electric wire 41 capable of penetrating into the combustion device 6.

Figure 4:
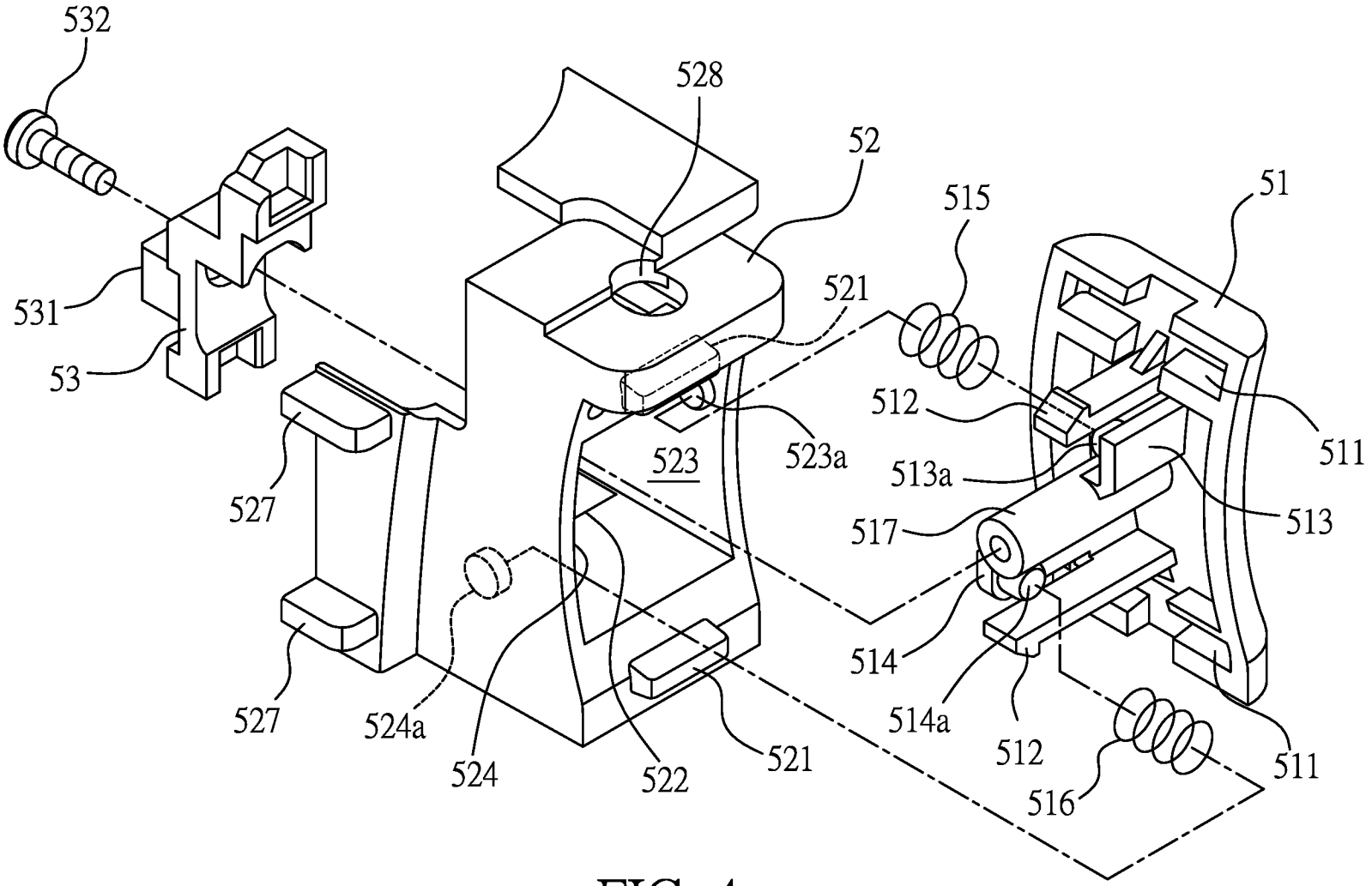
FIG. 4 is a perspective exploded view illustrating the safety switch according to the present invention.
Figure 5:
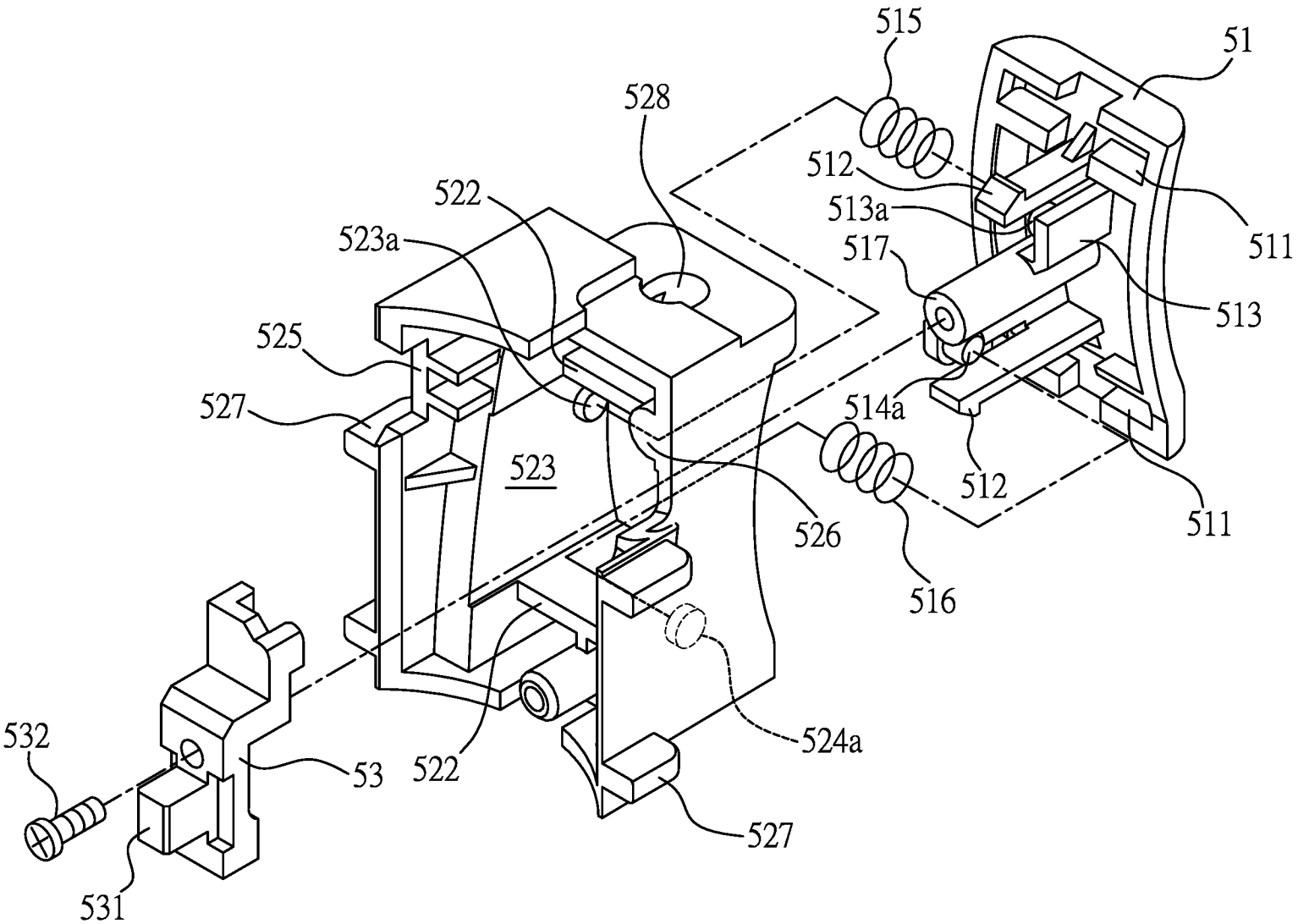
FIG. 5 is another perspective exploded view illustrating the safety switch according to the present invention.
Figure 6:
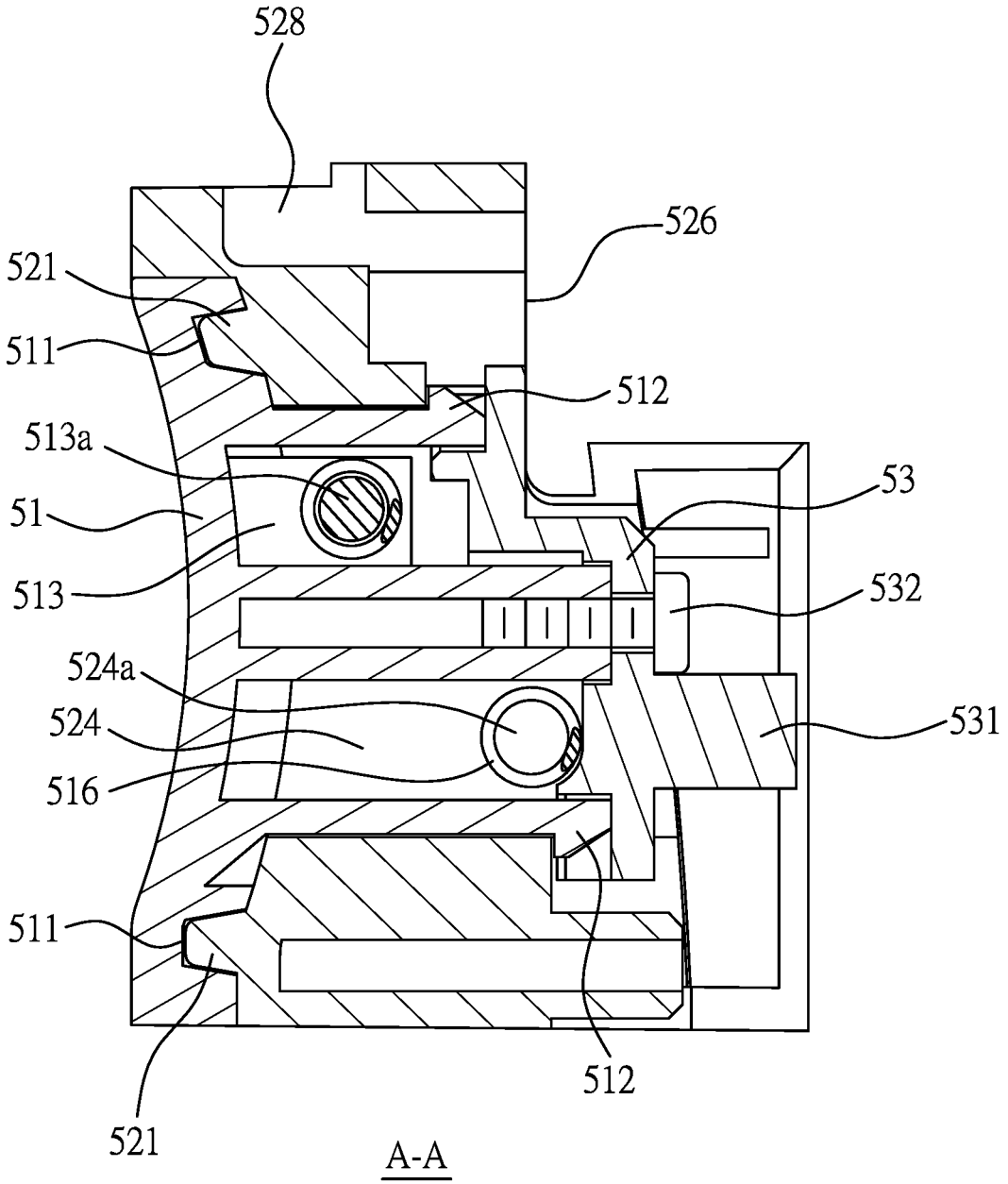
FIG. 6 is a cross sectional view of FIG. 1 taken along an A-A line.

Referring from FIG. 4 to FIG. 6, the safety switch 5 includes a slide member 51, a fasten member 52 and a passive member 53 capable of forming a linking status with the slide member 51. A rear surface of the slide member 51 is radially formed with at least one rail slot 511, axially extended with at least one buckle hook 512, and staggeringly formed, for example diagonally formed, with a left support arm 513 having an outer surface formed with a first positioning part 513*a* and a right support arm 514 having an outer surface formed with a second positioning part 514*a*, wherein the first positioning part 513*a* and the second positioning part 514*a* can be a tenon or a recess in actual practice, one end of a left spring 515 is disposed in the first positioning part 513*a*, and one end of a right spring 516 is disposed in the second positioning part 514*a*. As shown in FIG. 5 and FIG. 6, the top end and the bottom end defined on the rear surface of the slide member 51 are transversally formed with a pair of the above-mentioned rail slots 511, and a pair of the above-mentioned buckle hooks 512 are axially extended between the pair of rail slots 511.

The front end of the fasten member 52 is formed with at least one convex rail 521 allowing the at least one rail slot 511 to be received, so that each of the rail slots 511 is able to perform a radial sliding motion towards the left or the right along each of the convex rails 521. However, what shall be addressed is that the arrangement of the rail slot 511 and the convex rail 521 is not limited to the above-mentioned arrangement, the at least one rail slot 511 can be formed on the fasten member 52, and the at least one convex rail 521 can be formed on the slide member 51. In other words, adjacent surfaces of the slide member 51 and the fasten member 52 are correspondingly formed with the at least one rail slot 511 and the at least one convex rail 521 capable of being mutually sleeved, so that the slide member 51 is able to perform a radial sliding motion towards the left or the right relative to the fasten member 52. Accordingly, the at least one rail slot 511 and the at least one convex rail 521 can be defined as a radial sliding mechanism.

The interior of the fasten member 52 is formed with at least one buckle sheet 522 allowing the at least one buckle hook 512 to be buckled, so that the slide member 51 is prevented from being axially released from the front end of the fasten member 52, and the at least one buckle hook 512 is able to perform a radial sliding motion towards the left or the right along the at least one corresponding buckle sheet 522. Accordingly, the at least one buckle hook 512 and the at least one buckle sheet 522 can be defined as a connecting mechanism.

Figure 7A:
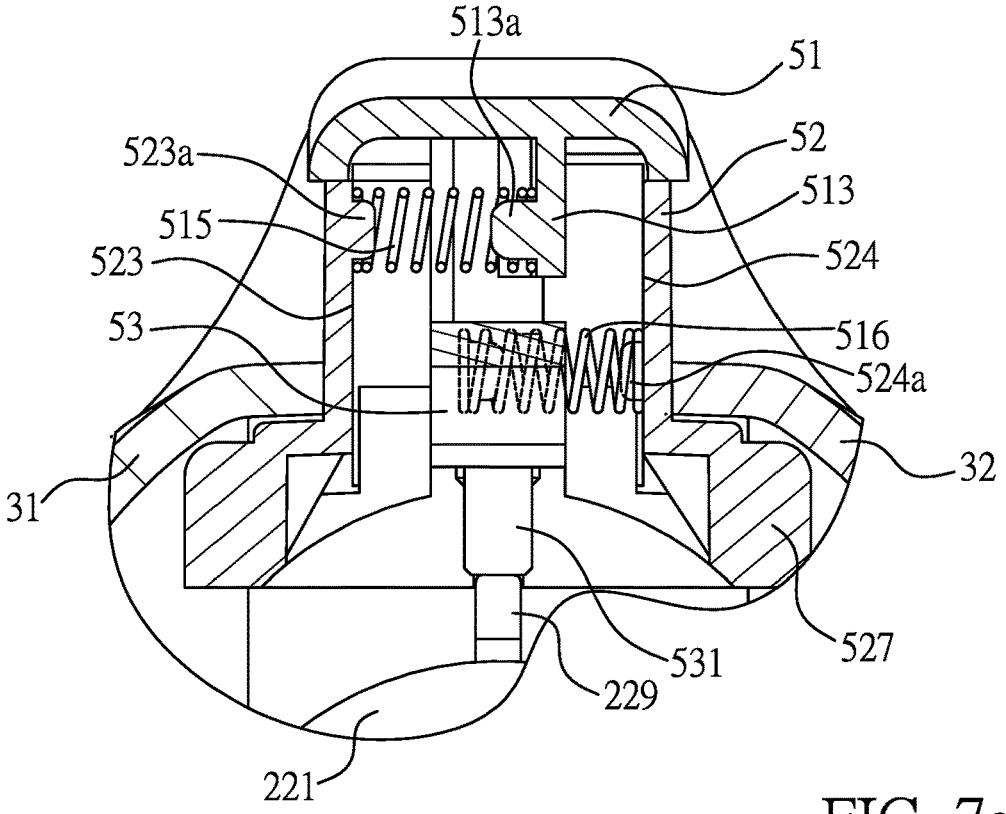
FIG. 7*a* is a partially enlarged cross sectional view illustrating the safety switch being in a locked status according to the present invention.

The fasten member 52 includes a left wall 523 and a right wall 524, an inner surface of the left wall 523 is formed with a third positioning part 523*a*, an inner surface of the right wall 524 is formed with a fourth positioning part 524*a*, wherein the third positioning part 523*a* and the fourth positioning part 524*a* can be a tenon or a recess in actual practice, the other end of the left spring 515 is disposed in the third positioning part 523*a*, the other end of the right spring 516 is disposed in the fourth positioning part 524*a*, so that the slide member 51 is able to be in a balanced static status relative to the fasten member 52 via a pushing effect formed through the left spring 515 and the right spring 516 being stretched (as shown in FIG. 7*a*).

Moreover, one side defined at the rear end of the fasten member 52, for example the left wall 523, is formed with a sleeve slot 525 allowing the piezoelectric device 4 to be sleeved, and another side defined at the rear end thereof, for example the right wall 524, is formed with a press surface 526 for pressing the air inlet control rod 223.

Furthermore, an outer surface of the left wall 523 and an outer surface of the right wall 524 are correspondingly and axially formed with at least one pair of guide tenons 527, the front opening 33 is formed with at least one pair of guide slots 332 (as shown in FIG. 2) allowing the at least one pair of guide tenons 527 to be received, but what shall be addressed is that the arrangement of the guide tenon 527 and the guide slot 332 is not limited to the above-mentioned arrangement. In other words, adjacent surfaces of the fasten member 52 and the front opening 33 can be correspondingly formed with the at least one pair of guide tenons 527 and the at least one pair of guide slots 332 capable of being mutually sleeved, so that the safety switch 5 is able to perform an axial sliding motion towards the rear or the front relative to the housing 3. Accordingly, the at least one pair of guide tenons 527 and the at least one pair of guide slots 332 can be defined as an axial sliding mechanism.

The passive member 53 is arranged at the rear end of the fasten member 52 and connected to the slide member 51 via a fastening structure, the fastening structure includes a connection rod 517 axially extended from the rear surface of the slide member 51 and a lock member 532, for example a screw, axially penetrating the passive member 53 and locked with the connection rod 517, so that the passive member 53 is able to synchronously perform a radial sliding motion towards the left or the right with the slide member 51. A rear surface of the passive member 53 is formed with a lock tenon 531, and the front end of the base 22 is formed with a block tenon 229 corresponding to the lock tenon 531. As such, when the lock tenon 531 is abutted against the block tenon 229, the safety switch 5 is unable to be pressed, thereby forming a locked status.

According to the above-mentioned assembly, FIG. 3 illustrates the assembly of the safety switch 5 and FIG. 6 is a cross sectional view illustrating the assembly of the safety switch 5; as shown in figures, it is easy to be known that the slide member 51 is able to perform the radial sliding motion at the front end of the fasten member 52 through the radial sliding mechanism (511, 521); the passive member 53 is able to be synchronously and radially moved with the slide member 51 through the connecting structure (532, 517); and the slide member 51 is able to be slidably disposed at the front end of the fasten member 52 through the connecting mechanism (512, 522), and a situation of being axially released can be prevented.

The combustion device 6 includes a combustion pipe 61 and a connection ring 62. The bottom end of the combustion pipe 61 is inserted in the insertion slot 227 located in the top opening 35 and served to enclose the gas ejecting nozzle 226, the bottom end of the combustion pipe 61 is formed with at least one ventilation hole 611 for introducing air from air guiding slots 351 preformed at two sides of the top opening 35, so that the introduced air is able to enter the combustion pipe 61 through the at least one ventilation hole 611 for being mixed with the fuel gas ejected by the gas ejecting nozzle 226 thereby forming a mixed fuel gas.

The connection ring 62 is combined, for example screwed, with the top opening 35 and allows the combustion pipe 61 to pass, a downstream end of the combustion pipe 61 is disposed with a gas guiding unit 612 for guiding the flowing direction of the mixed fuel gas. The electric wire 41 is extended to the periphery of the gas guiding unit 612 for igniting the mixed fuel gas.

As shown in FIG. 3, the fuel gas controlling device 2 is disposed at the top end of the gas container 1, the piezoelectric device 4 is disposed in the housing 3, the safety switch 5 is disposed in the front opening 33, and the combustion device 6 is inserted in the insertion slot 227 of the fuel gas controlling device 2, so that the combustion device 6 can be replaced with respect to different combustion requirements.

Referring to FIG. 7*a*, when the slide member 51 is provided with the pushing effect formed through the left spring 515 and the right spring 516 being stretched, the slide member 51 is able to be in the balanced static status relative to the fasten member 52. At this moment, the lock tenon 531 of the passive member 53 is abutted against the block tenon 229 of the fuel gas controlling device 2, so that the safety switch 5 is unable to be pressed, thereby forming a lucked status.

Figure 7B:
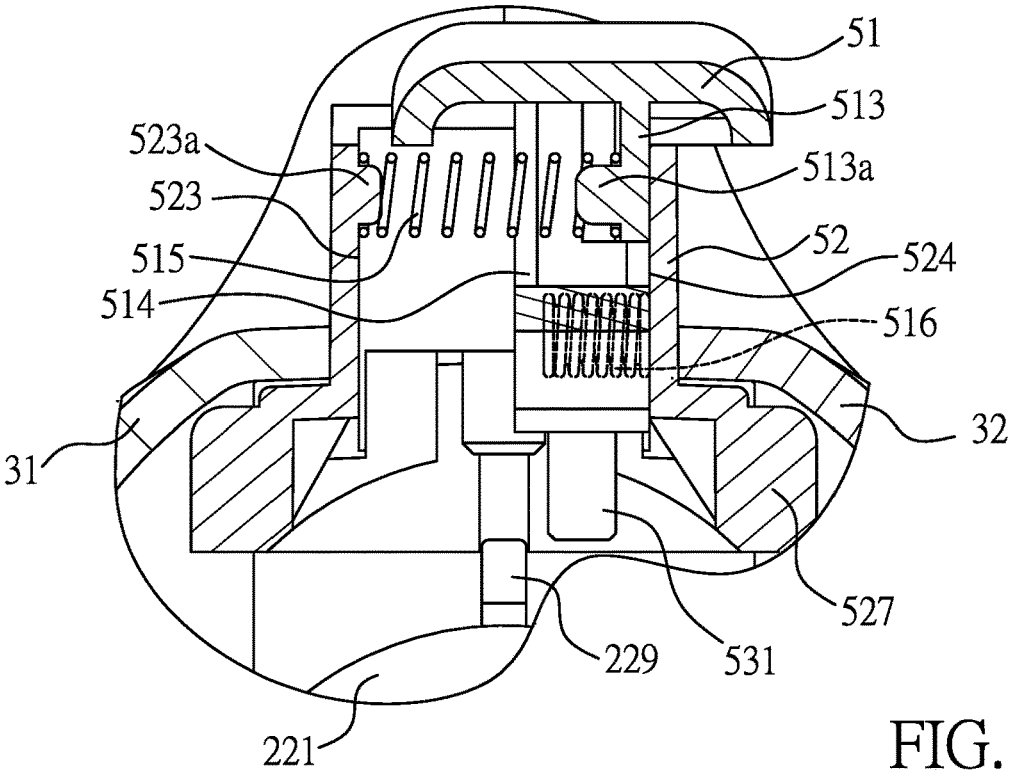
FIG. 7*b* is a partially enlarged cross sectional view illustrating the safety switch being pulled towards the right for forming an unlocked status according to the present invention.

Referring to FIG. 7*b*, when the user uses his/her right hand to pull the slide member 51 towards the right, the rail slots 511 are slid towards the right along the corresponding convex rails 521, the right support arm 514 is enabled to compress the right spring 516 (storing energy), and the left spring 515 is in a stretched status (releasing energy), so that the lock tenon 531 of the passive member 53 is released from the block tenon 229 of the fuel gas controlling device 2, thereby forming an unlocked status.

Figure 7C:
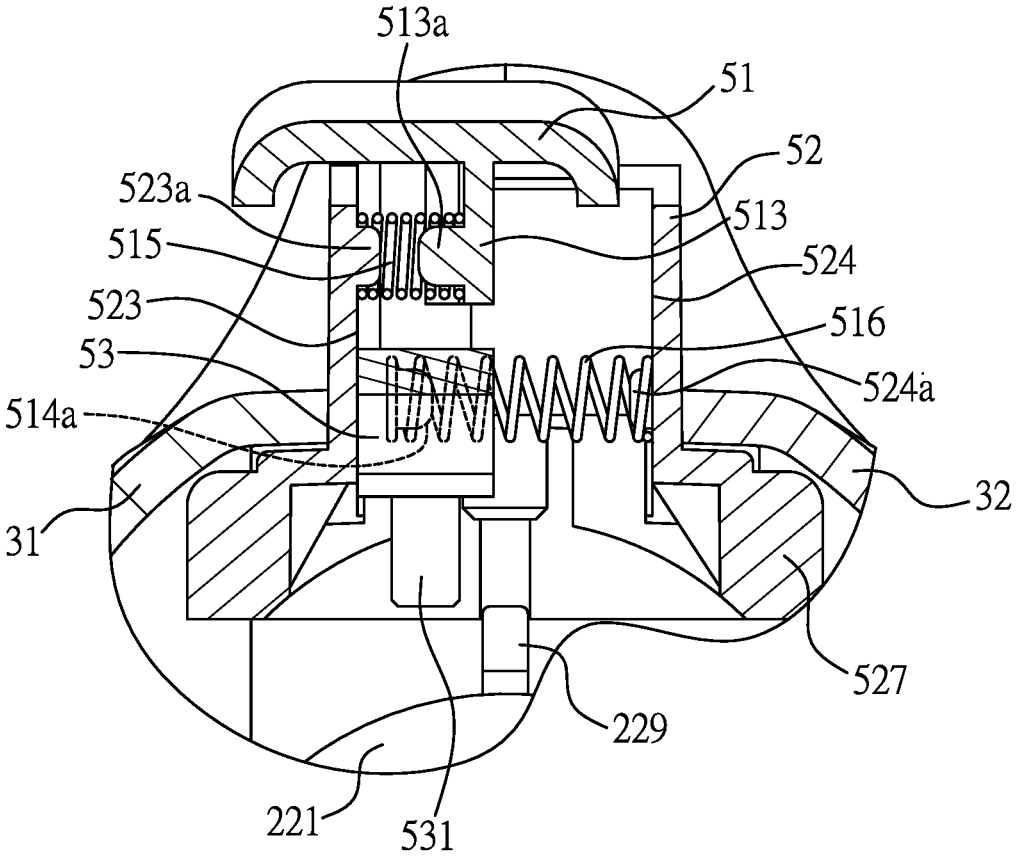
FIG. 7*c* is a partially enlarged cross sectional view illustrating the safety switch being pulled towards the left for forming an unlocked status according to the present invention.

Referring to FIG. 7*c*, when the user uses his/her left hand to pull the slide member 51 towards the left, the rail slots 511 are slid towards the left along the corresponding convex rails 521, the left support arm 513 is enabled to compress the left spring 515 (storing energy), and the right spring 516 is in a stretched status (releasing energy), so that the lock tenon 531 of the passive member 53 is moved towards the right and released from the block tenon 229 of the fuel gas controlling device 2, thereby forming another unlocked status.

Figure 8A:
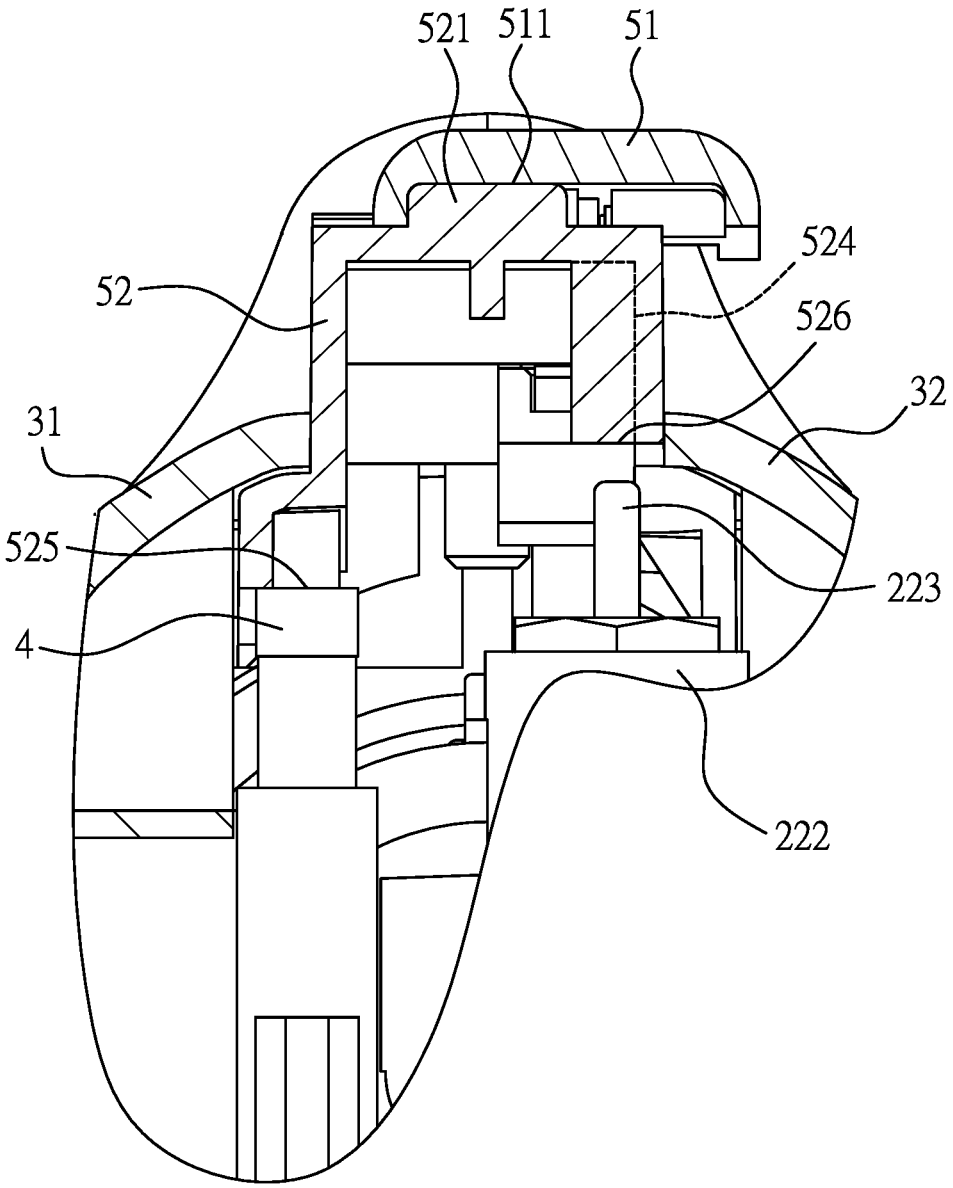
FIG. 8*a* is another partially enlarged cross sectional view illustrating the safety switch being pulled towards the right for forming an unlocked status according to the present invention.

Referring to FIG. 8*a*, which is a cross sectional view of FIG. 7*b* from another viewing angle and shows a status of the safety switch being unlocked but yet being pressed. The left wall 523 of the fasten member 52 is connected to the piezoelectric device 4 through the sleeve slot 525, and the press surface 526 of the right wall 524 is spaced a distance from the air inlet control rod 223.

Figure 8B:
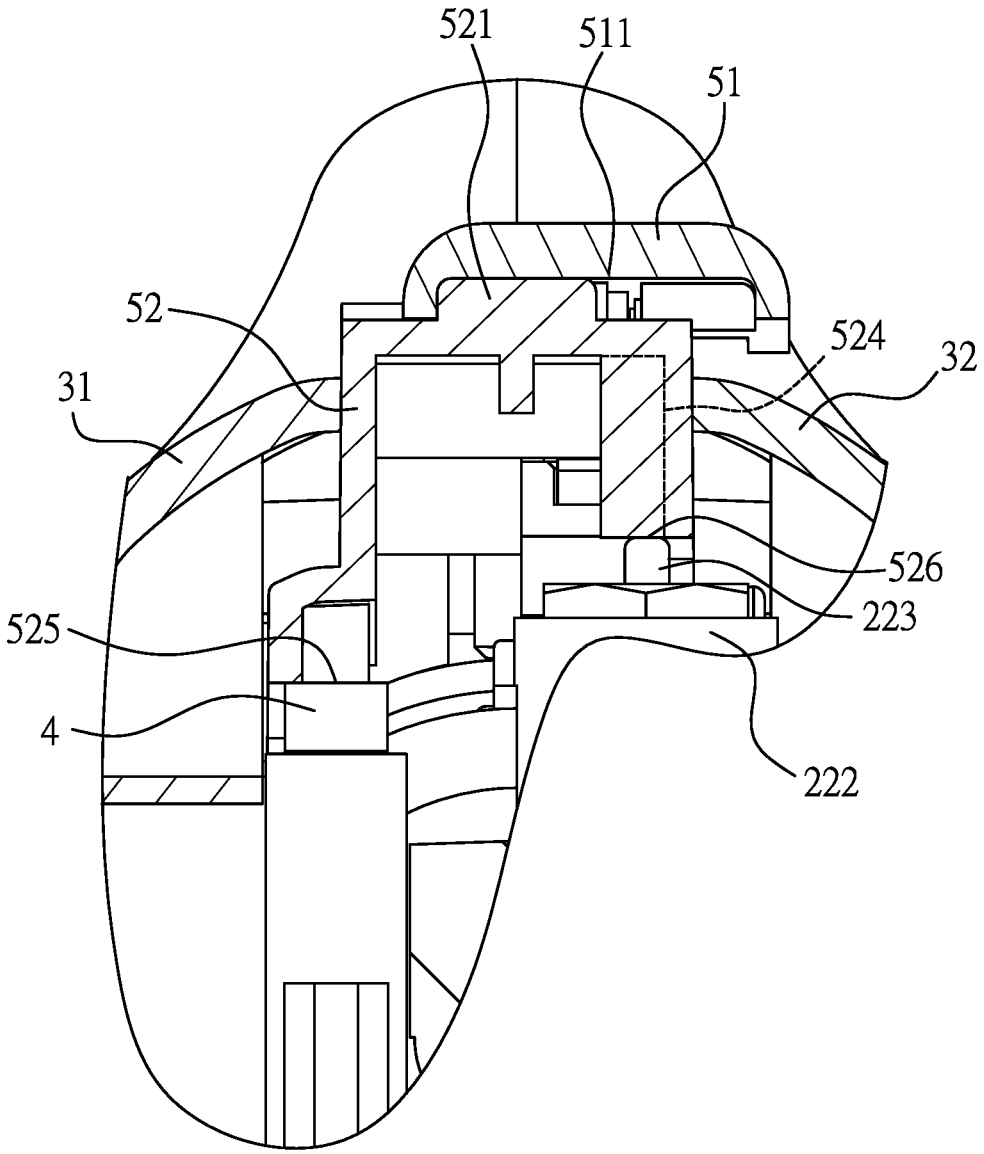
FIG. 8*b* is a partially enlarged cross sectional view illustrating the safety switch being pressed for forming a gas supplying and igniting status according to the present invention.

Referring to FIG. 8*b*, when the user presses the safety switch 5, the guide tenons 527 are slid towards the rear along the corresponding guide slots 332, the sleeve slot 525 and the press surface 526 are both enabled to push the piezoelectric device 4 and the air inlet control rod 223, so that the fuel gas passageway in the fuel gas controlling device 2 is opened for allowing the fuel gas to be ejected from the gas ejecting nozzle 226 and entering the combustion pipe 61 for being mixed with the air, then the mixed fuel gas is ejected from the gas guiding unit 612, and the electric wire 41 located at the periphery of the gas guiding unit 612 is served to generate static sparks for igniting the mixed fuel gas for processing the combustion operation.

As shown from FIG. 1 to FIG. 3, a top surface of the fasten member 52 is additionally formed with an elongated circular fasten hole 528. The top end of the housing 3 further includes a continuous button 39, the continuous button 39 is sleeved with a spring 391 then disposed in a continuous opening 30 formed on the housing 3 corresponding to the location of the safety switch 5.

Figure 9A:
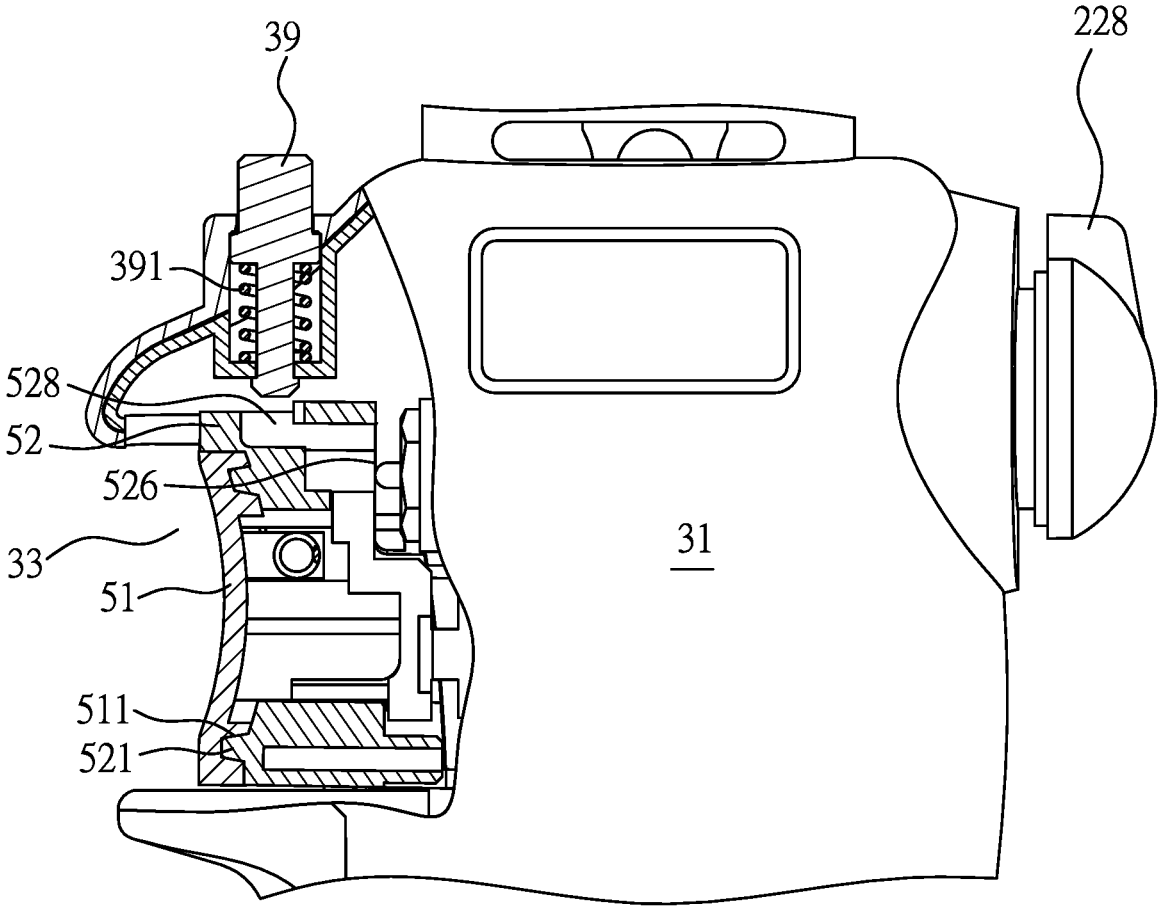
FIG. 9*a* is a cross sectional view illustrating the continuous button not being operated.
Figure 9B:
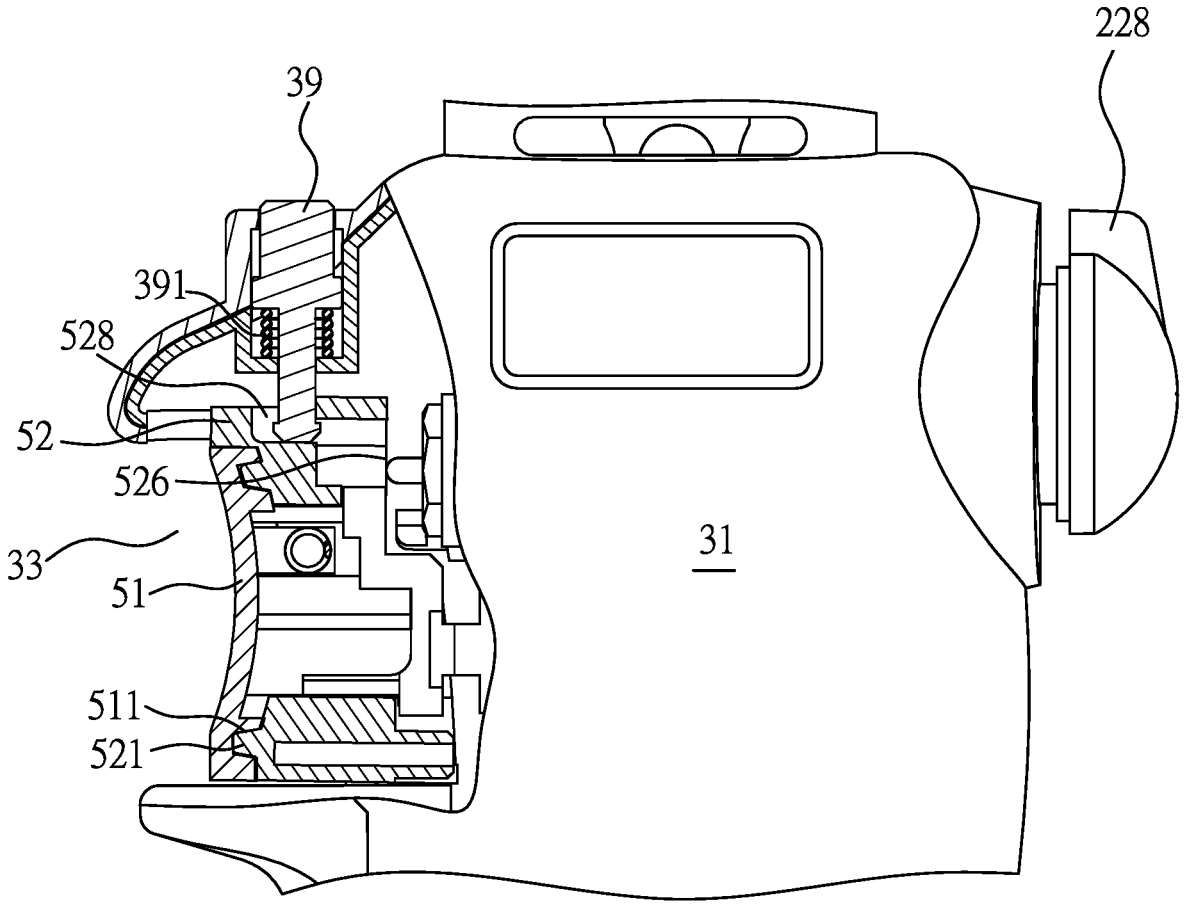
FIG. 9*b* is a cross sectional view illustrating the continuous button being operated.

Referring to FIG. 9*a*, which is a cross sectional view of FIG. 8*b* from another viewing angle and shows a status of the safety switch being unlocked and pressed. At this moment, the fasten hole 528 of the fasten member 52 is located right below the continuous button 39, if the combustion operation is desired to be continuously processed, the user only has to press the continuous button 39, the spring 391 is compressed (storing energy) and the continuous button 39 is able to enter the fasten hole 528, so the user can release the safety switch 5 for allowing the safety switch 5 to be provided with a recovering action provided by the piezoelectric device 4, and the continuous button 39 can be kept in the fasten hole 528, so that a continuously pressing status as shown in FIG. 9*b* can be formed through the interfere effect on the safety switch 5 provided by the continuous button 39.

When the combustion operation is finished, the user only has to press the safety switch 5 again, so that the continuous button 39 is no longer buckled by the fasten hole 528, at this moment the spring 391 is stretched (releasing energy) for enabling the continuous button 39 to be released from the fasten hole 528, and the safety switch 5 is recovered to the original location as shown in FIG. 7*a* through the recovering action provided by the piezoelectric device 4.

Based on what has been disclosed above, advantages achieved by the present invention are as followings: with the slide member being provided with function of capable of being bidirectionally unlocked and pressed for operation, the user can easily operate the gas combustor no matter he/she is a left-hand or right-hand user, so the gas combustor provided by the present invention can be used by any user, thereby increasing the operation convenience. Accordingly, the gas combustor provided by the present invention is novel and more practical in use comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas combustor, comprising:

a gas container, with the top end thereof formed with a connection part having a discharging nozzle;

a fuel gas controlling device, including a base connected to said connection part, wherein the exterior of said base is formed with a block tenon, and the interior thereof is formed with a fuel gas passageway for receiving fuel gas supplied from said discharging nozzle, an upstream end of said fuel gas passageway is disposed with an air inlet control valve, said air inlet control valve is closed in a normal status, and the front end of said air inlet control valve is axially disposed with an air inlet control rod capable of allowing an opened loop to be formed, so that said fuel gas is able to be discharged from a gas ejecting nozzle disposed at a downstream end of said fuel gas passageway, said gas ejecting nozzle is received in an insertion slot allowing a combustion device to be inserted and positioned;

a housing, used for enclosing and fastening said gas container and said fuel gas controlling device, and including a front opening and a top opening allowing said combustion device to be disposed, wherein the interior of said front opening is formed with a fasten slot allowing a piezoelectric device to be disposed therein, and said piezoelectric device includes an electric wire capable of penetrating into said combustion device; and a safety switch, slidably disposed in said front opening and including a slide member, a fasten member and a passive member; adjacent surfaces of said slide member and said fasten member are disposed with a connecting mechanism and a radial sliding mechanism, wherein a rear surface of said slide member is staggeringly arranged with a left support arm and a right support arm, said fasten member is formed with a left wall and a right wall respectively corresponding to said left support arm and said right support arm, a left spring is disposed between said left support arm and said left wall, and a right spring is disposed between said right support arm and said right wall, thereby enabling said slide member to perform a radial sliding motion towards the left or the right at the front end of said fasten member and preventing said slide member from being axially released; said passive member is arranged at the rear end of said fasten member and connected to said slide member via a fastening structure, and a rear surface of said passive member is formed with a lock tenon capable of being abutted against said block tenon, thereby forming a lucked status;

when said slide member is pulled towards the left or the right, said passive member is synchronously moved with said slide member, and said lock tenon is released from said block tenon, thereby forming an unlocked status, so that said safety switch is able to be pressed in said front opening, and said piezoelectric device and said air inlet control rod are respectively squeezed and pushed at the same time.

2. The gas combustor as claimed in claim 1, wherein said connecting mechanism includes at least one buckle hook and at least one buckle sheet formed respectively and oppositely on adjacent surfaces of said slide member and said fasten member for engaging with each other.

3. The gas combustor as claimed in claim 1, wherein said radial sliding mechanism includes at least one rail slot and at least one convex rail formed respectively and oppositely on adjacent surfaces of said slide member and said fasten member for engaging with each other.

4. The gas combustor as claimed in claim 1, wherein said fastening structure includes a connection rod axially extended from said rear surface of said slide member and a lock member axially penetrating said passive member and locked with said connection rod.

5. The gas combustor as claimed in claim 1, wherein an outer surface of said left support arm is formed with a first positioning part, an inner surface of said left wall is formed with a third positioning part, so that said left spring is disposed in said first positioning part and said third positioning part; an outer surface of said right support arm is formed with a second positioning part, an inner surface of said right wall is formed with a fourth positioning part, so that said right spring is disposed in said second positioning part and said fourth positioning part.

6. The gas combustor as claimed in claim 5, wherein said first positioning part, said second positioning part, said third positioning part and said fourth positioning part are tenons or recesses.

7. The gas combustor as claimed in claim 1, wherein one side defined at the rear end of said fasten member is formed with a sleeve slot allowing said piezoelectric device to be sleeved, and another side defined at said rear end thereof is formed with a press surface for pressing said air inlet control rod.

8. The gas combustor as claimed in claim 1, wherein an outer surface of said left wall, an outer surface of said right wall and an inner surface of said front opening are correspondingly and axially formed with at least one pair of guide tenons and at least one pair of guide slots allowing said at least one pair of guide tenons to be received.

9. The gas combustor as claimed in claim 1, wherein the bottom end of said gas container is provided with a filling nozzle.

10. The gas combustor as claimed in claim 1, wherein said fuel gas controlling device further includes a fuel gas vaporizing device, said fuel gas vaporizing device is connected to said discharging nozzle, so that said discharging nozzle is able to be in an intermittent fuel gas supplying status for allowing said fuel gas to be stably vaporized in said fuel gas vaporizing device, said fully-vaporized fuel gas is discharged from a gas discharging hole formed at the top end of said fuel gas vaporizing device so as to enter said fuel gas passageway formed in said base.

11. The gas combustor as claimed in claim 10, wherein the bottom end of said base is disposed with a hollow supporter connected to said connection part, thereby allowing said fuel gas vaporizing device to be disposed in said supporter.

12. The gas combustor as claimed in claim 1, wherein said fuel gas passageway further includes a discharging adjustment valve having a function of adjusting a fuel gas discharging amount, a discharging adjustment rod is provided and rotated in said discharging adjustment valve for adjusting said discharging amount, so that a diameter of said fuel gas passageway is able to be adjusted with a shielding means.

13. The gas combustor as claimed in claim 12, wherein said housing is formed with a rear opening, a button is disposed in said rear opening, and said button is sleeved with said discharging adjustment rod and capable of being synchronously rotated.

14. The gas combustor as claimed in claim 1, wherein said housing is formed with a bottom opening allowing a bottom cover to be disposed, and said bottom cover is served to open or close said bottom opening.

15. The gas combustor as claimed in claim 14, wherein a connection strip made of an elastic polymer material is provided for connecting said bottom cover and said housing.

16. A safety switch for use in gas combustor, slidably disposed in an opening of a gas combustor and comprising a slide member, a fasten member and a passive member; wherein adjacent surfaces of said slide member and said fasten member are disposed with a connecting mechanism and a radial sliding mechanism, a rear surface of said slide member is staggeringly arranged with a left support arm and a right support arm, said fasten member is formed with a left wall and a right wall respectively corresponding to said left support arm and said right support arm, a left spring is disposed between said left support arm and said left wall, and a right spring is disposed between said right support arm and said right wall, thereby enabling said slide member to perform an elastic radial sliding motion towards the left or the right at the front end of said fasten member and preventing said slide member from being axially released; said passive member is arranged at the rear end of said fasten member and connected to said slide member via a fastening structure, and a rear surface of said passive member is formed with a lock tenon capable of being abutted against a block tenon preformed in said gas combustor, thereby forming a locked status; when said slide member is pulled towards the left or the right, said passive member is synchronously moved with said slide member, and said lock tenon is released from said block tenon, thereby forming an unlocked status, so that said safety switch is able to be pressed in said opening.

17. The safety switch for use in gas combustor as claimed in claim 16, wherein said connecting mechanism includes at least one buckle hook and at least one buckle sheet formed respectively and oppositely on adjacent surfaces of said slide member and said fasten member for engaging with each other.

18. The safety switch for use in gas combustor as claimed in claim 16, wherein said radial sliding mechanism includes at least one rail slot and at least one convex rail formed respectively and oppositely on adjacent surfaces of said slide member and said fasten member for engaging with each other.

19. The safety switch for use in gas combustor as claimed in claim 16, wherein said fastening structure includes a connection rod axially extended from said rear surface of said slide member and a lock member axially penetrating said passive member and locked with said connection rod.

20. The safety switch for use in gas combustor as claimed in claim 16, wherein an outer surface of said left support arm is formed with a first positioning part, an inner surface of said left wall is formed with a third positioning part, so that said left spring is disposed in said first positioning part and said third positioning part; an outer surface of said right support arm is formed with a second positioning part, an inner surface of said right wall is formed with a fourth positioning part, so that said right spring is disposed in said second positioning part and said fourth positioning part.

21. The safety switch for use in gas combustor as claimed in claim 20, wherein said first positioning part, said second positioning part, said third positioning part and said fourth positioning part are tenons or recesses.

22. The safety switch for use in gas combustor as claimed in claim 16, wherein one side defined at the rear end of said fasten member is formed with a sleeve slot allowing a piezoelectric device to be sleeved, and another side defined at said rear end thereof is formed with a press surface for pressing an air inlet control rod.

23. The safety switch for use in gas combustor as claimed in claim 16, wherein an outer surface of said left wall, an outer surface of said right wall and an inner surface of said opening are correspondingly and axially formed with at least one pair of guide tenons and at least one pair of guide slots allowing said at least one pair of guide tenons to be received.

* * * * *